US006164649A

United States Patent [19]

Perkitny

[11] Patent Number: 6,164,649

[45] Date of Patent: Dec. 26, 2000

[54] PUZZLE

[76] Inventor: Jerzy Perkitny, 28115 Osborn Rd., Bay Village, Ohio 44140

[21] Appl. No.: 09/370,779

[22] Filed: Aug. 5, 1999

[51] Int. Cl.[7] ..... A63F 9/08

[52] U.S. Cl. ..... 273/156; 273/160

[58] Field of Search ..... 273/157 R, 153 R, 273/156, 153 S, 160; 446/120, 121, 122, 124, 125

[56] References Cited

U.S. PATENT DOCUMENTS

| | | | |
|---|---|---|---|
| D. 237,640 | 11/1975 | Baynes | 273/156 |
| 4,008,526 | 2/1977 | Swett et al. . | |
| 4,246,718 | 1/1981 | Chatani | 446/124 |
| 5,106,093 | 4/1992 | Engel | 446/124 |
| 5,116,052 | 5/1992 | Pop | 273/153 S |
| 5,564,703 | 10/1996 | McGuire | 273/153 S |

*Primary Examiner*—Steven Wong
*Attorney, Agent, or Firm*—Watts, Hoffmann, Fisher & Heinke Co.

[57] ABSTRACT

A puzzle comprising a first puzzle unit having a semi-cubical first portion pivotally connected to a second semi-cubical portion. The portions are moveable to a closed position wherein the puzzle unit has a cubical shape formed by six walls of equal size. A biasing compression spring acting between the first and second portions urges the puzzle unit portions away from each other about the pivot towards an open position. A first triangular shaped cut-out is defined by the first unit portion and a second triangular shaped cut-out is defined by the second unit portion. The first and second cut-outs are arranged such that when the first and second unit portions are moved into abutting contact, the cut-outs confront each other and define a diamond shaped opening in opposed side walls of the puzzle unit. A first protruding member extends from a side wall of the first unit portion and a second protruding member extends from a corresponding side wall of the second unit portion. The members are arranged such that when the first and second portions are moved into an abutting position, the members define a protrusion that is sized to be received in a recess defined by an adjacent puzzle unit, such that maintaining closure of the adjacent puzzle unit maintains the first puzzle unit in its closed position.

23 Claims, 20 Drawing Sheets

PUZZLE

TECHNICAL FIELD

The present invention relates generally to games and puzzles and, in particular, a puzzle/game that requires mental agility and manual dexterity in order to maintain the assembly of a plurality of puzzle units.

DISCLOSURE OF INVENTION

The present invention provides a novel puzzle, or game, of the type that requires both mental agility and manual dexterity. A variety of puzzles are available which challenge players to test their manual skills. One advantage of the present invention is that it is playable by people of a broad range of ages, and also enables players of different ages and skill levels to play with one another. Players are also able to use the present invention either alone or with others, and to practice and improve certain abilities, such as hand-eye coordination, and mental and manual dexterity, by experimenting or playing with the variety of puzzles available. The puzzle of the present invention is also simple to manufacture and safe for use by players of all ages.

Further objects and advantages of the present invention will be referred to in or become apparent from the following descriptions of the preferred embodiments of the invention.

BEST MODE FOR CARRYING OUT THE INVENTION

Figure 1:
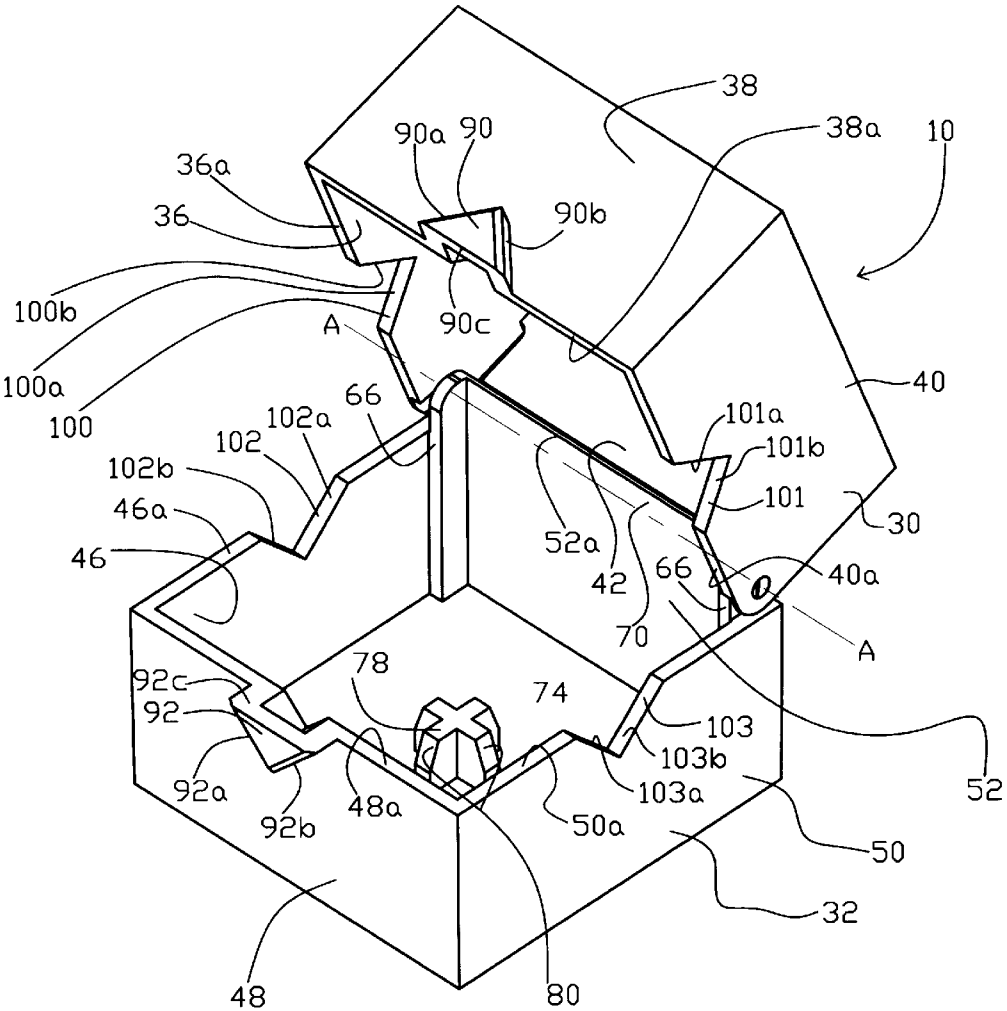
FIG. 1 is a perspective view of a puzzle unit constructed in accordance with a preferred embodiment of the invention.
Figure 2:
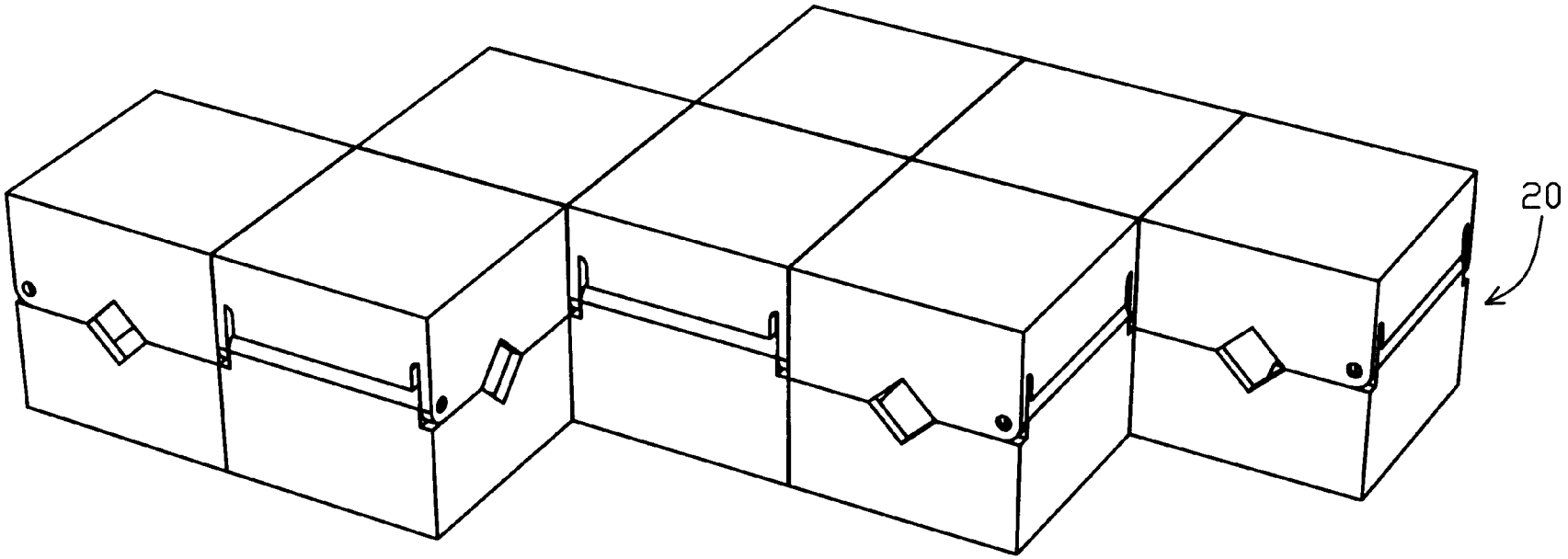
FIG. 2 is a perspective view showing a plurality of puzzle units arranged in a self-locking relationship.
Figure 3:
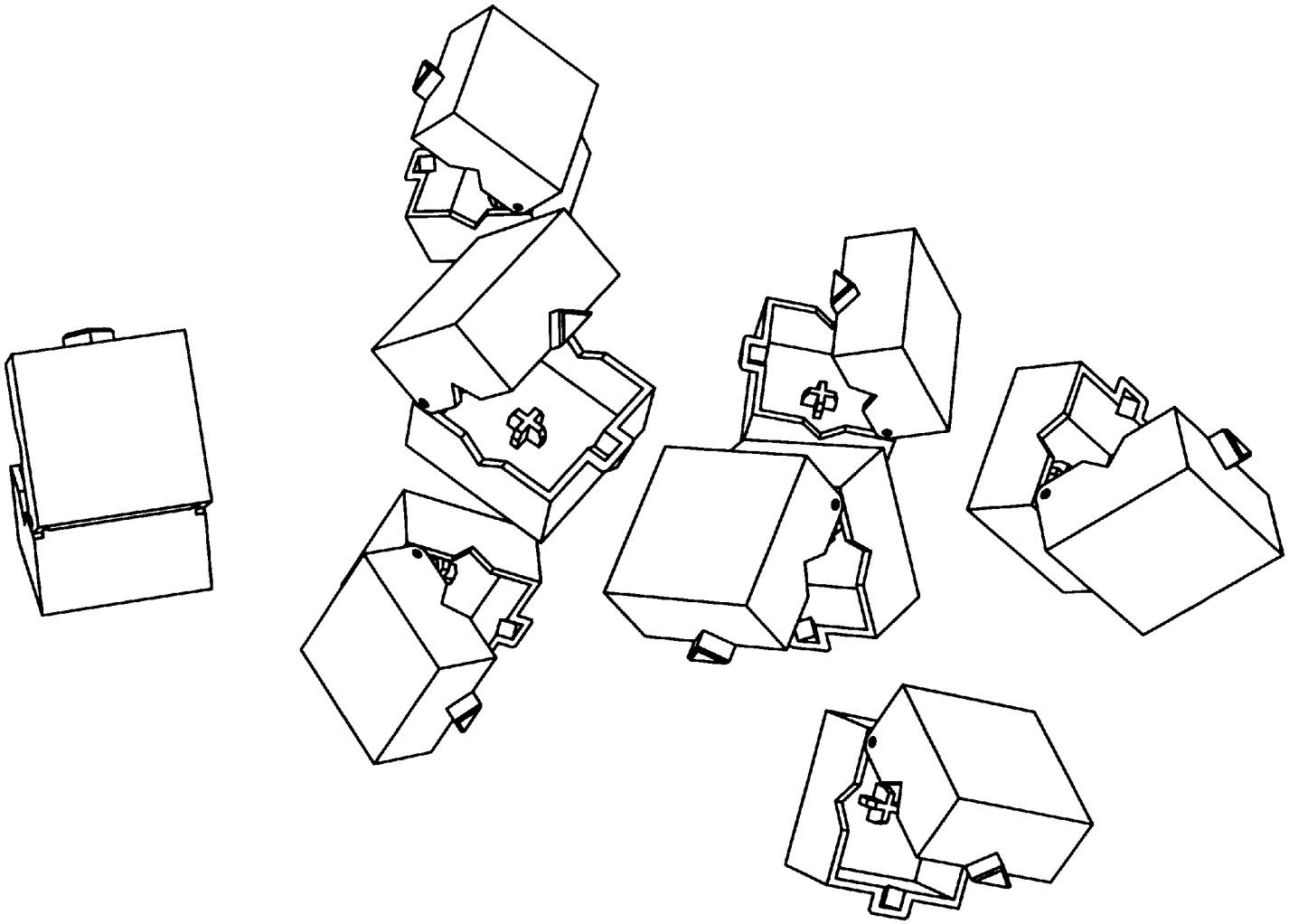
FIG. 3 is a perspective view showing an example of how the puzzle units separate if not configured properly in a self-locking relationship.

Referring to FIG. 1 of the drawings, a puzzle cube of the present invention is generally designated at reference character 10. FIG. 2 shows a plurality of cubes 10 assembled in a particular combination to form an intact puzzle assembly 20. As will be described below, the individual cubes 10 are capable of being interconnected to maintain a complete puzzle assembly wherein all of the cubes 10 are self-locked in a closed position (as shown, for example, in FIG. 2). The cubes 10 may also be interconnected in various arrangements such that their assembly does not self-lock, in which case the cubes 10 separate, or snap away, from each other. This occurs when the interconnection made between the cubes 10 is incapable of maintaining the cubes 10 in their closed position (as shown, for example, in FIG. 3).

Figure 4B:
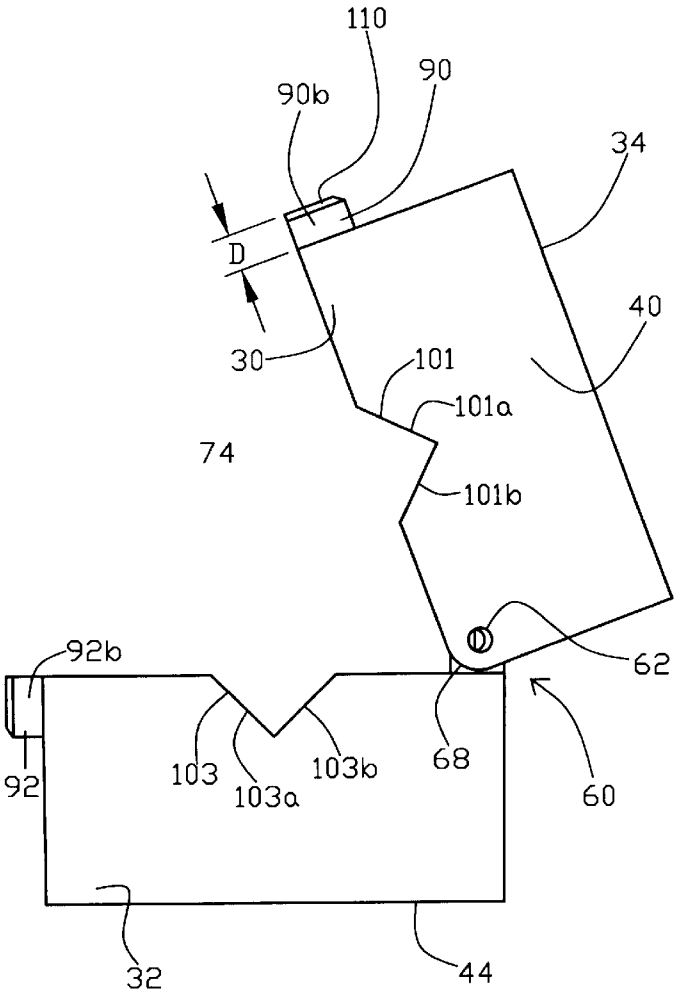
FIGS. 4A and 4B show front and end views, respectively, of the puzzle unit shown in FIG. 1.
Figure 4A:
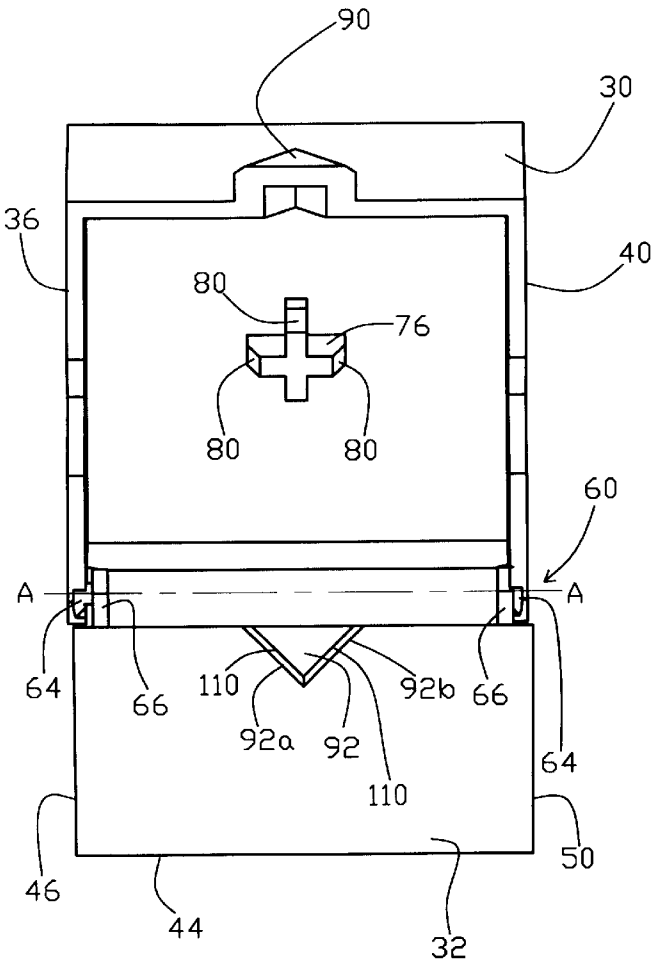
Figure 5B:
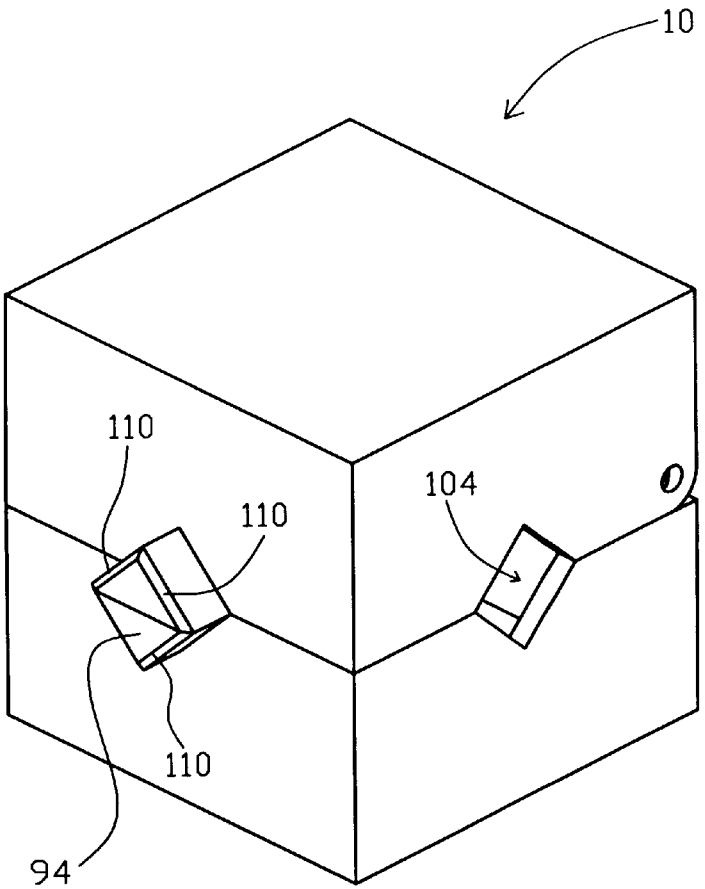
FIG. 5A and 5B are perspective views of a puzzle unit shown in a "closed, position.
Figure 5A:
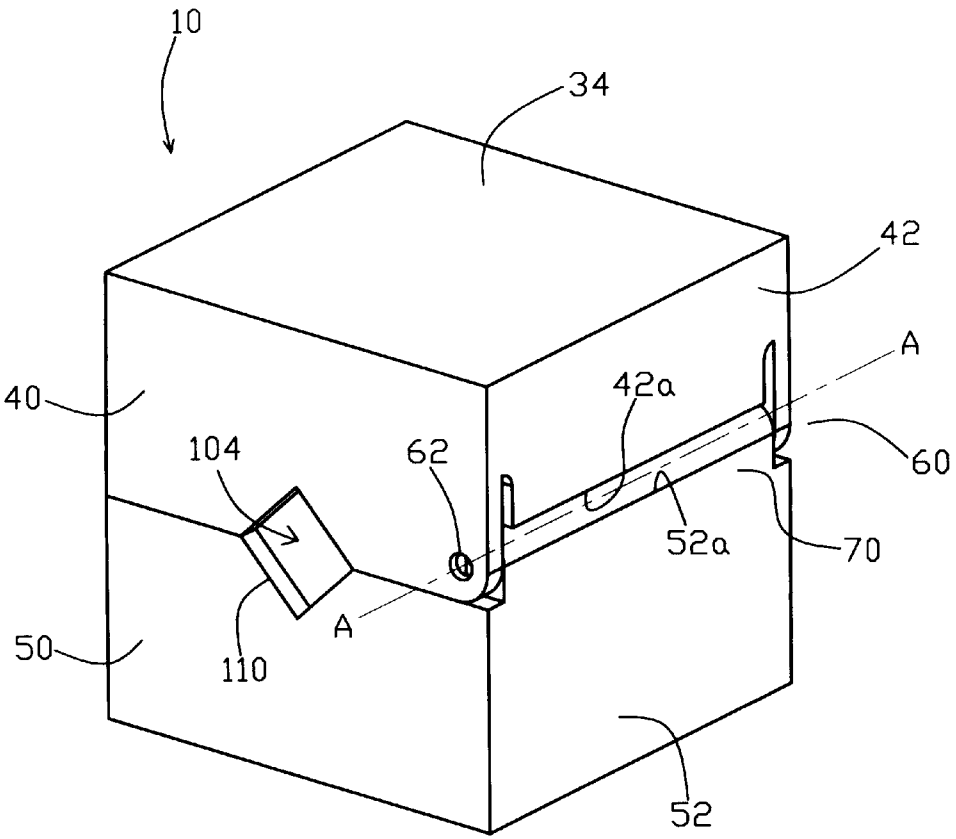

Referring to FIGS. 1, 4A and 4B, each cube 10 includes a top cube half 30 and a bottom cube half 32. The top cube half 30 includes a square top wall 34 and four side walls 36, 38, 40 and 42. The top 34 and side walls 36, 38, 40 and 42 form an open "half-cube-shaped" structure. Likewise, the bottom cube half 32 includes a square bottom wall 44 and four side walls 46, 48, 50, 52 that form an open "half-cube-shaped" structure. When the top and bottom cube halves 30, 32 are maintained in a closed position as shown in FIG. 5, edges 36*a*, 38*a*, 40*a* of the side walls 36, 38, 40 of the top cube half 30 abut edges 46*a*, 48*a*, 50*a* of the side walls 46, 48, 50 of the bottom cube half 32 to form four square side walls that are substantially equal in size to the top 34 and bottom 44 walls of the top and bottom cube halves 30, 32. As a result, a hollow cube-shaped structure is formed when an individual cube 10 is maintained in a closed position.

The top cube half 30 and bottom cube half 32 pivot relative to each other about a pivot axis A—A. The relative pivotal movement between the top and bottom halves 30, 32 is provided by means of a hinge connection, generally designated at reference character 60. The hinge connection 60 is located between the edges 42*a*, 52*a* of the back side walls 42,52 of the cube halves 30, 32. The top cube half 30 defines a hole, or socket 62, in its left and right side walls 36, 40 in relatively close proximity to its back side wall 42. The bottom cube half 32 includes a pair of cylindrical pivot arms 64 in its left and right side walls 46, 50 that are received by the sockets 62 of the top cube half 30. As shown in FIGS. 1 and 4A the left and right side walls 46, 50 include structural members 66 to provide additional structural support near the pivot arms 64.

The left and right side walls 36, 40 of the top cube half 30 include arcuate portions 68 near the sockets 62 to provide sufficient clearance between the two cube halves 30, 32 as one cube half is moved relative to the other cube half. A portion 70 of the back side wall 52 of the bottom cube half 32 extends upward and, therefore, the back side wall 52 is relatively higher than the three other corresponding side walls 46, 48, 50 of the bottom cube half 32. This heightened portion 70 of the back side wall 52 provides the necessary height to accommodate the pivot arms 64 of the bottom cube half 32. Accordingly, the back side wall 42 of the top cube half 30 is relatively shorter than the three other corresponding side walls 35, 38 40 of the top cube half 30 to provide sufficient clearance between the edges 42*a*, 52*a* of the two back side walls 42, 52.

The two cube halves 30, 32 are continuously urged away from each other about the pivot axis A—A by means of a coil spring 74. The coil spring 74 is contained within each cube half 30, 32 and is under compression when the two cube halves 30, 32 are maintained in a closed position. Thus, to hold a particular cube 10 closed, a force must be exerted on the top and bottom cube halves 30, 32 sufficient to overcome the spring forces exerted on the inside of the cube halves 30, 32 by the spring 74.

The top and bottom cube halves 30, 32 include nub elements 76, 78, respectively that secure ends of the coil spring 74. The lower nub element 78 is centered on the bottom wall 44 of the bottom cube half 34 and the upper nub element 76 is centered on the top wall 34 of the top cube half 30. The nub elements 76, 78 include chamfered edges 80 to facilitate easy installation of the spring ends onto the nub elements 76, 78. The width of each nub element 76, 78 is slightly larger than the diameter of the coil spring 74 to cause frictional engagement between each end of the spring 74 and the nub elements 76, 78. This frictional engagement inhibits the spring 74 from slipping off of the nub elements 76, 78 because of, for example, rapid opening of the top and bottom cube halves 30, 32. The size and spring rate of the spring 74 are selected so that the spring 74, when in its expanded state, is capable of flexing a predefined radius defined by the distance from axis A—A to the center of the nub elements 76, 78. Another factor in selecting the size and spring rate of the spring 74 is the spring's ability to compress without buckling out of place or interfering with the functional characteristics of the hinge connection 60 or the closing of the cube 10.

Each cube 10 of a particular puzzle includes top and bottom triangular-shaped protrusions 90, 92 opposite the hinge connection 60. The top and bottom protrusions 90, 92 extend outwardly from their respective front side walls 38, 48. The left legs 90*a*, 92*a* and right legs 90*b*, 92*b* of the triangular-shaped protrusions 90, 92 are equal in length and at right angles to each other. Accordingly, the shape of the protrusions 90, 92 is also that of a square divided along its diagonal.

The protrusion 90 of the top cube half 30 is located at the bottom center of the front side wall 38. In the illustrated embodiment, the leg of unequal length 90*c* of the top protrusion 90 lies in the same plane as that of the bottom edge 38*a* of the front side wall 38. Likewise, the protrusion 92 of the bottom cube half 32 is located at the top center of the front side wall 48 and the leg of unequal length 92*c* of the bottom protrusion 92 lies in the same plane as that of the top edge 48*a* of the front side wall 48. As a result, when the two cube halves 30, 32 are maintained in a closed position, the two triangular-shaped protrusions 90, 92 are joined together to form a single diamond-shaped protrusion 94 (shown in FIGS. 5B and 7) located in the center of the front side of the cube 10. Because the left 90*a*, 92*a* and right legs 90*b*, 92*b* of the triangular-shaped protrusions 90, 92 are equal in length and at right angles to each other, the shape of the protrusions when the cube 10 is in a closed position is also that of a square rotated 45 degrees about its center.

Each cube half 30, 32 also includes a pair of triangular-shaped cut-outs 100, 101, 102, 103. One cut-out 100, 102 is located in the left side wall 35, 46 and one cut-out 101, 103 is located in the right side wall 40, 50 of each respective cube half 30, 32. The cut-outs 100, 101, 102, 103 correspond in cross-sectional configuration to the triangular-shaped protrusions 90, 92 on the front sides 38, 48 of the cube halves 30, 32. Thus, each triangular-shaped cut-out 100, 101, 102, 103 includes a left leg 100*a*, 101*a*, 102*a*, 103*a* and a right leg 100*b*, 101*b*, 102*b*, 103*b* that correspond in length to the left legs 90*a*, 92*a* and right legs 90*b*, 92*b* of the triangular-shaped protrusions 90, 92, and, when the cube 10 is maintained in a closed position the triangular shaped cut-outs 100, 101, 102, 103 are joined together to form a single diamond-shaped opening 104 (shown in FIG. 5). The diamond-shaped openings are located in the center of the left side of the cube 10 and the center of the right side of the cube 10.

The diamond shaped protrusion 94 (shown in FIGS. 5B and 7) of a cube 10 is adapted to be inserted into the similarly shaped openings 104 of another cube 10. As shown in the illustrated embodiment, the protrusion 94 includes chamfered edges 110 to facilitate introduction of the protrusion 94 into one of the corresponding openings 104. Once the protrusion 94 is inserted into an opening 104 of a closed cube and the cube halves 30, 32 of the inserted cube are released, the cube halves 30, 32 urge apart as do the two triangular-shaped protrusions 90, 92 within the opening 104 so that the triangular-shaped protrusions 90, 92 engage the inside perimeter of the diamond-shaped opening 104 of the closed cube. The depth D of the protrusion 94 (shown in FIG. 4B) is formed such that the protrusion 94 will remain in an opening 104 of a closed cube after insertion therethrough and is subsequent released.

Figure 6:
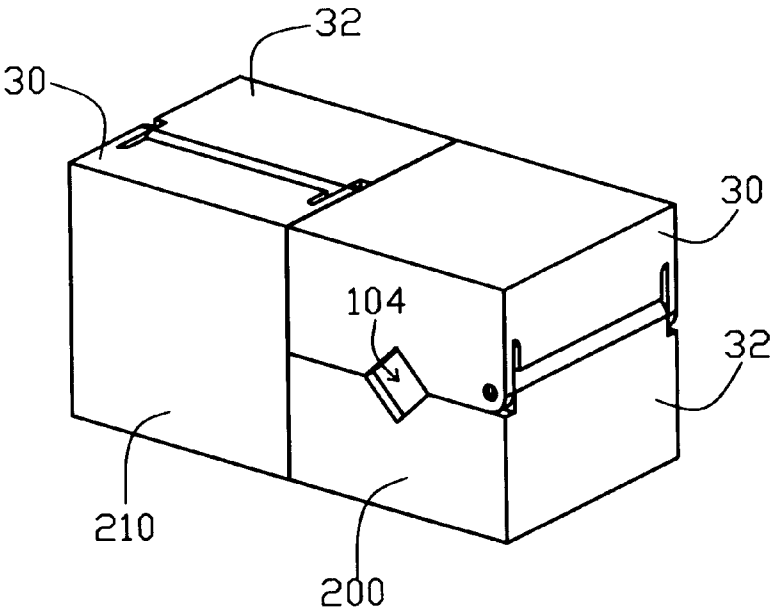
FIG. 6 illustrates the interconnection of two puzzle units.
Figure 9:
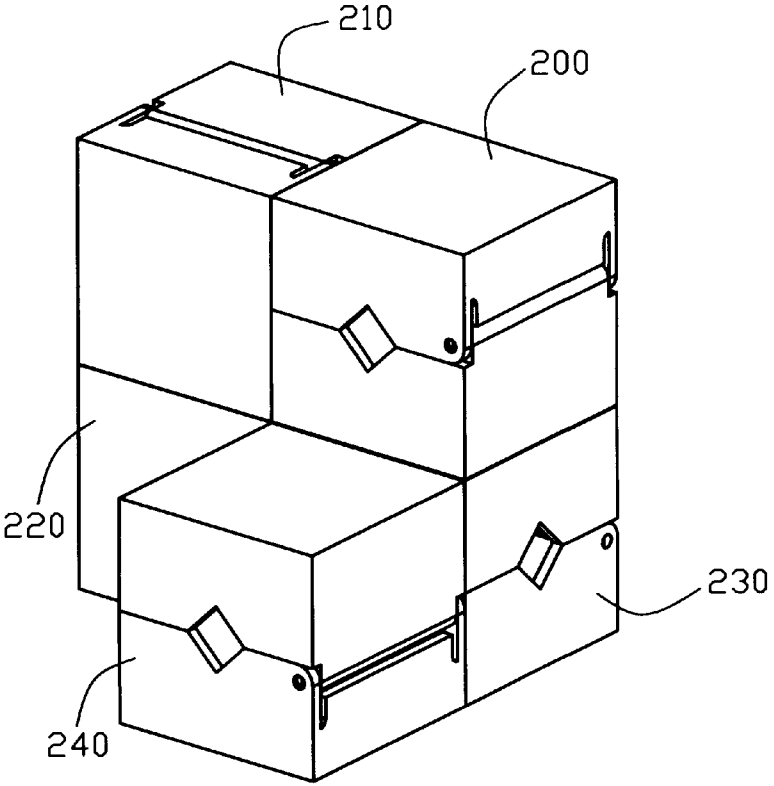
FIG. 9 illustrates five puzzle units being interconnected.

Referring now to FIG. 6, the protrusion of a cube 200 that is held closed can be inserted into either the left side wall opening or the right side wall opening of a second cube 210 held closed. In FIG. 6, the cube 200 is inserted into the right side wall of the cube 210. As discussed above, the protrusion 94 and the openings 104 have a "rotated square" shape. Consequently, the cube 200 and, accordingly, the protrusion 94 of the cube 200, can be removed from a particular opening 104 of the second cube 210, rotated 90 degrees, and then reinserted into the same opening 104 of the second cube 210. Altogether, there are eight different puzzle arrangements in which a cube held closed can be inserted into another cube held closed, four into the left side wall and four into the right side wall. For any of the eight different puzzle arrangements, the second cube 210 retains the first cube 200 in a closed position so long as the second cube 210 is held closed. If the second cube 210 is released, thereby letting the cube halves 30, 32 separate via the spring forces within the second cube 210, then the inserted cube 200 will also open up via the spring forces within the inserted cube 200.

Figure 7:
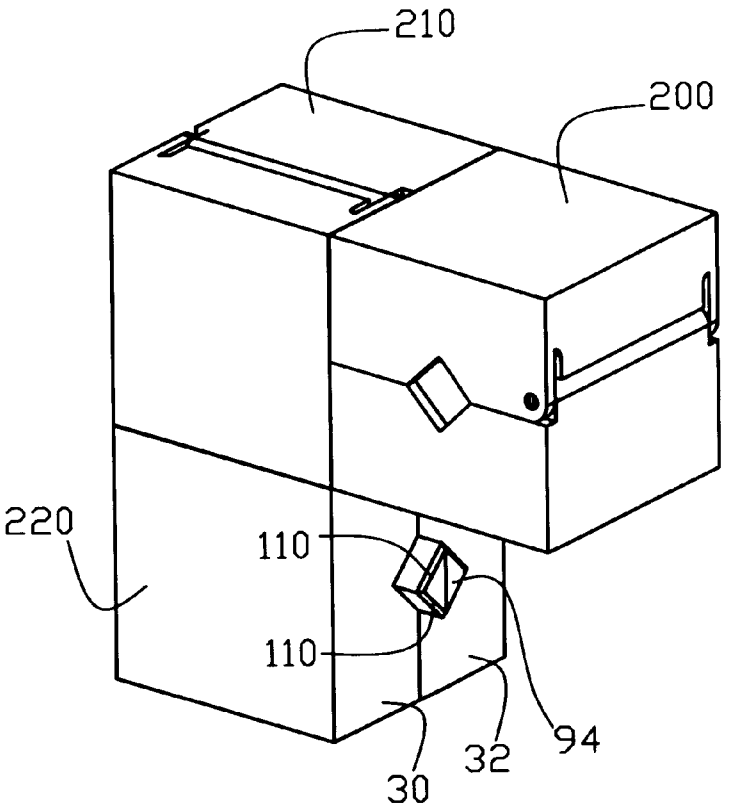
FIG. 7 shows the interconnection of three puzzle units.

Referring now to FIG. 7, by holding the second cube 210 closed an additional third cube 220 held closed can be added to make a three-cube puzzle arrangement. As shown in FIG. 7, this can be accomplished by, for example, inserting the second cube 210 into either the left side wall opening or the right side wall opening of the third closed cube 220. To prevent either of the first or second cubes 200, 210 from opening, the third cube 220 must be maintained in a closed position. Alternatively, the additional third cube 220 can be inserted into the openings of the first or second cubes 200, 210, in which case the second cube 210 would have to be retained in a closed position. For any three-cube puzzle arrangement, the cube having the exposed protrusion (cube 220 in FIG. 7) requires retention by a force external to the three-cube arrangement to keep the cubes 200, 210, 220 from separating. The other two "inserted" cubes (cubes 200 and 210 in FIG. 7) will remain in a closed position so long as the cube 220 having the exposed protrusion is held closed. If the cube 220 having the exposed protrusion is released, thereby letting its cube halves 30, 32 separate, then the inserted cubes 200, 210 will also open up.

As can be understood by the two and three cube puzzle arrangements discussed above, as the number of cubes 10 increases so does the number of possible combinations to assemble a particular puzzle arrangement of the cubes 10.

According to the invention, to complete a puzzle the particular cube arrangement must be able to "self lock." In other words, the combination of cubes 10 must be arranged so that they remain closed by means of the particular interconnection of the cubes 10 and not by a force external to the cube arrangement.

Figure 8:
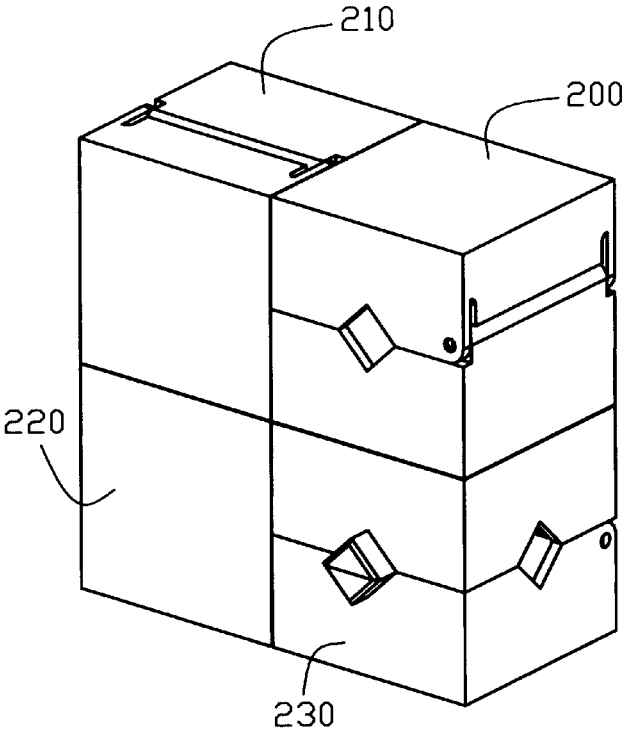
FIG. 8 shows the interconnection of four puzzle units.
Figure 11:
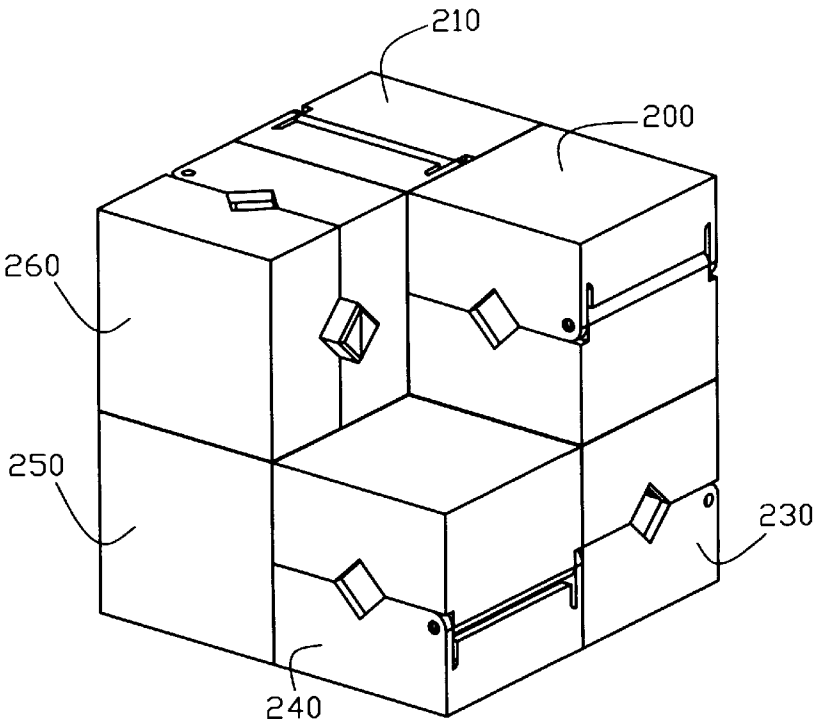
FIG. 11 illustrates the interconnection of seven puzzle units.
Figure 10:
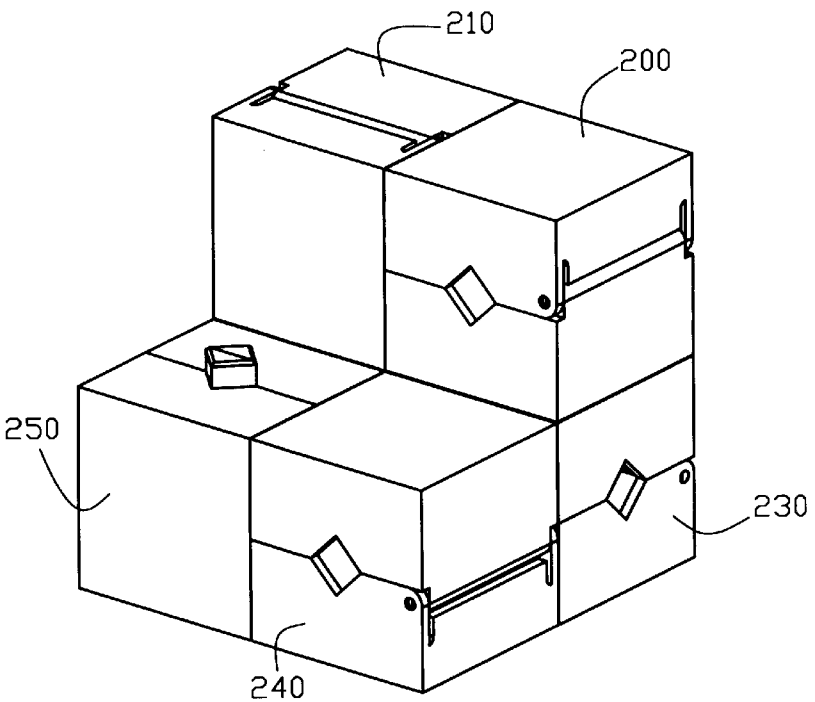
FIG. 10 illustrates the interconnection of six puzzle units.

This can be accomplished, for example, by a four-cube puzzle arrangement wherein the protrusion 94 of the third cube is inserted into a side wall of the fourth cube and the protrusion of the fourth cube is inserted into a side wall of the first cube. In such a puzzle arrangement, all of the four cubes remain in a closed position by way of the particular interconnection of the cubes. Of course, not every four-cube arrangement is capable of self-locking, as shown, for example, in FIG. 8. In this four cube arrangement, which is simply an addition of a cube 230 to the three-cube arrangement shown in FIG. 7, the fourth cube 230, if released, will open up, or separate, causing the other cubes 200, 210, 220 to also open up. In fact, there is no way to add a fourth cube 230 to the three-cube arrangement of FIG. 7 to form a self-locking four-cube arrangement.

Figure 13:
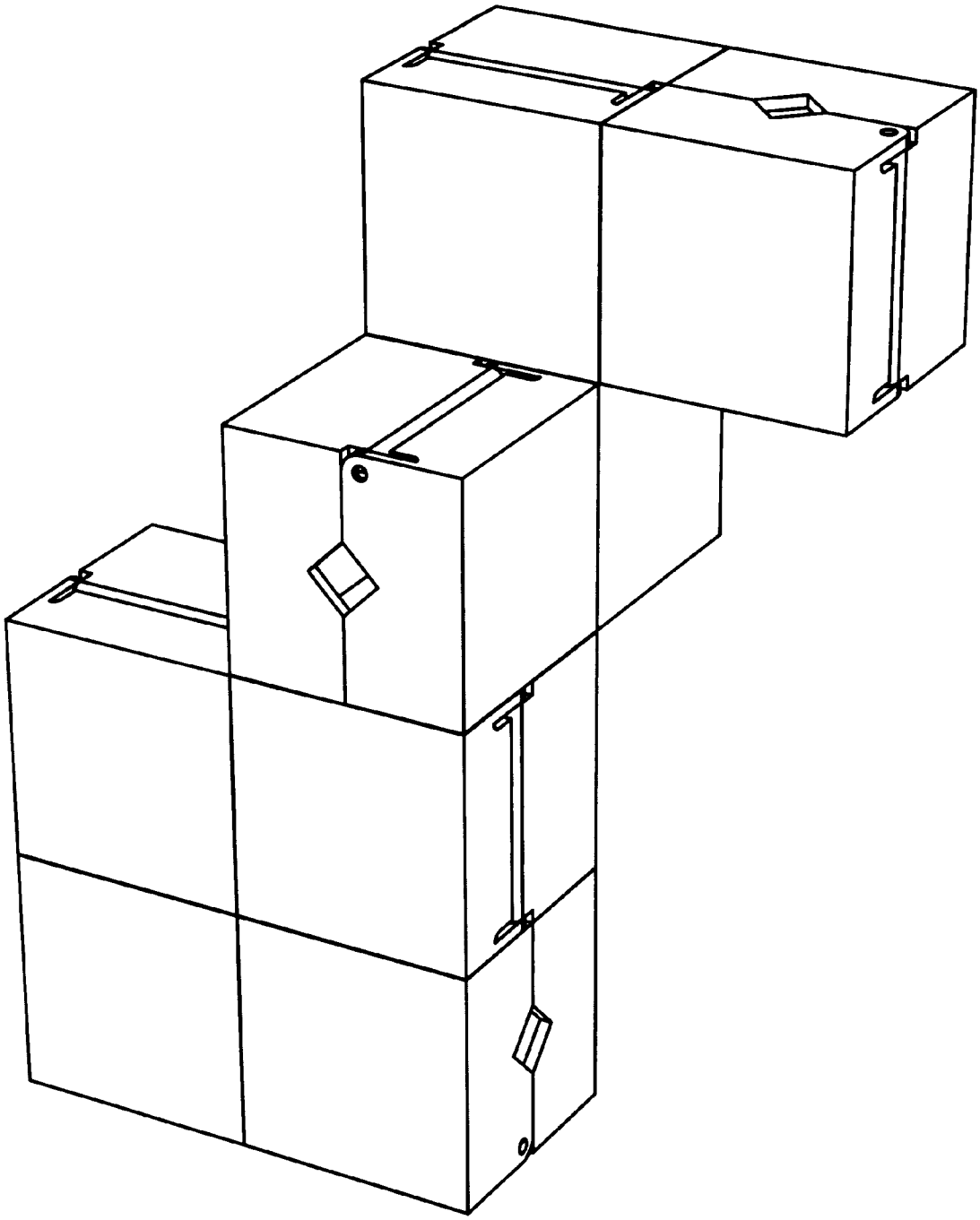
FIG. 13 illustrates the interconnection of eight puzzle units arranged in a non-symmetrical pattern in self locking relationship.

A complete self-locking puzzle arrangement must comprise four or more closed cubes although some arrangements may comprise any number of cubes and yet not self lock (see, for example, FIGS. 6 through 11). A self-locked five-cube puzzle arrangement can be assembled by inserting the protrusion 94 of the fifth additional cube into one of the available openings 104 of the four closed cubes that comprise the four-cube self-locked arrangement discussed above. Additional cubes 10 can be continuously added to create various shaped puzzle arrangements by inserting the protrusion 94 of the "to-be-added cube" into one of the openings 104 of the closed cubes 10 of the existing self-locked arrangement. See, for example, the eight-cube self-locked arrangements in FIGS. 2 and 13.

Figure 12:
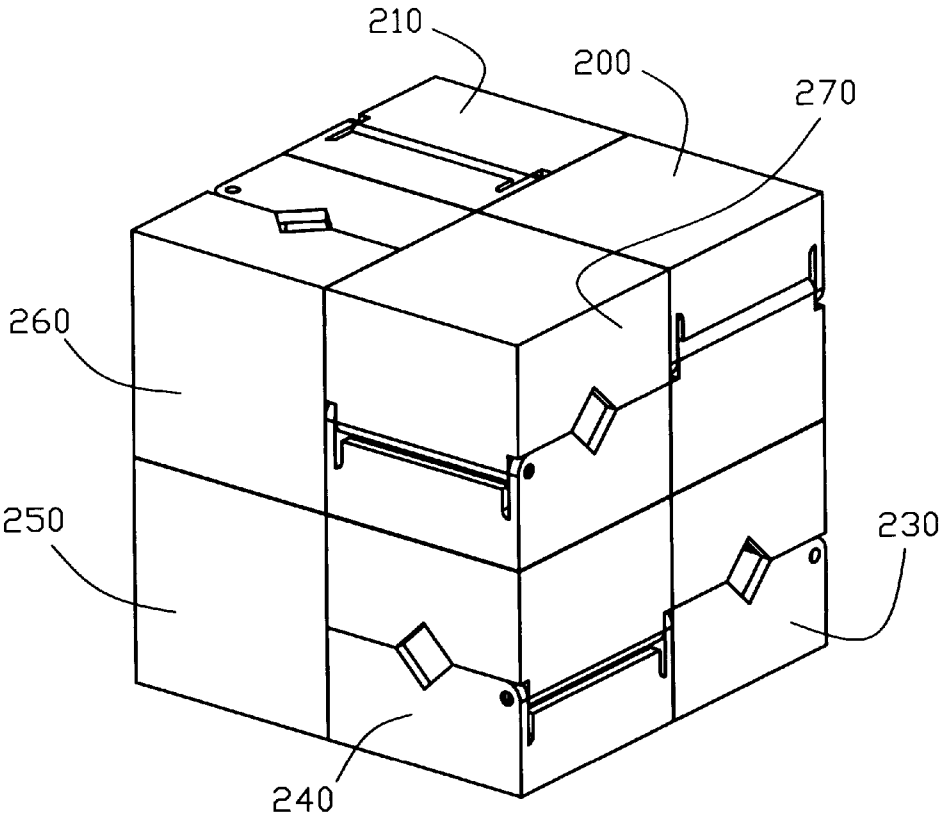
FIG. 12 illustrates the interconnection of eight puzzle units in self locking relationship.

Factors which may increase the level of difficulty in assembling a particular puzzle arrangement may include the number of cubes 10 to be interconnected, the desired shape of the particular puzzle and the environmental limitations of the puzzle arrangement, for example, the direction in which the particular puzzle arrangement is to be built. By way of comparison, see FIGS. 2 and 13. The eight-cube self-locked arrangement shown in FIG. 2 is relatively more unstable, and thus more difficult to assemble, than the eight-cube arrangement shown in FIG. 13 since the former is built in an upstanding configuration and the latter in a horizontal configuration upon a surface. FIG. 12 shows another eight-cube self-locked arrangement different than the previously mentioned eight-cube self-locked arrangements in FIGS. 2 and 13. Here, the eighth cube 270 is the final cube that completes the puzzle. None of the cube arrangements preceding this eight-cube arrangement were self-locking. Thus, during assembly of this puzzle, the most recent cube always had to be held in a closed position to prevent separation of the other cubes (that is, by a force external to the cube arrangement) until the eighth cube 270 was installed. FIGS. 6 through 11 show the individual steps (i.e., the addition of "held-closed" cubes 210, 220, 230, 240, 250 and 260), in succession until the insertion of the eighth cube 270, to arrive at the eight-cube self-locked puzzle arrangement shown in FIG. 12. Obviously, other factors can increase the level of difficulty in completing a puzzle as well, like the spring rate of the spring, the size, color or material of the cubes, or patterns which may be painted on the cubes.

Figure 15:
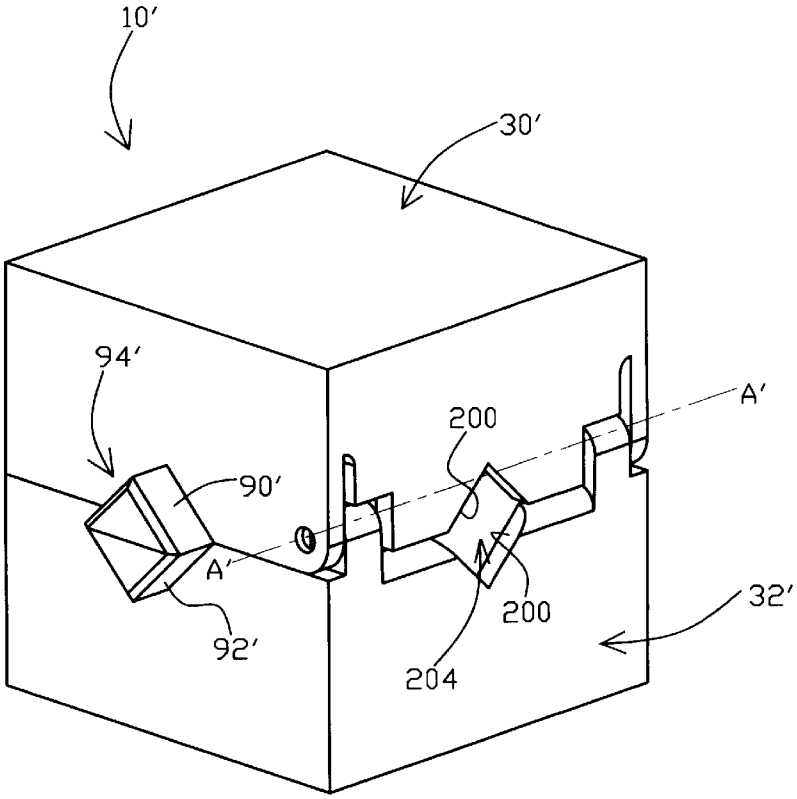
FIGS. 14 and 15 are perspective views of a puzzle unit constructed in accordance with an alternate embodiment of the invention.
Figure 14:
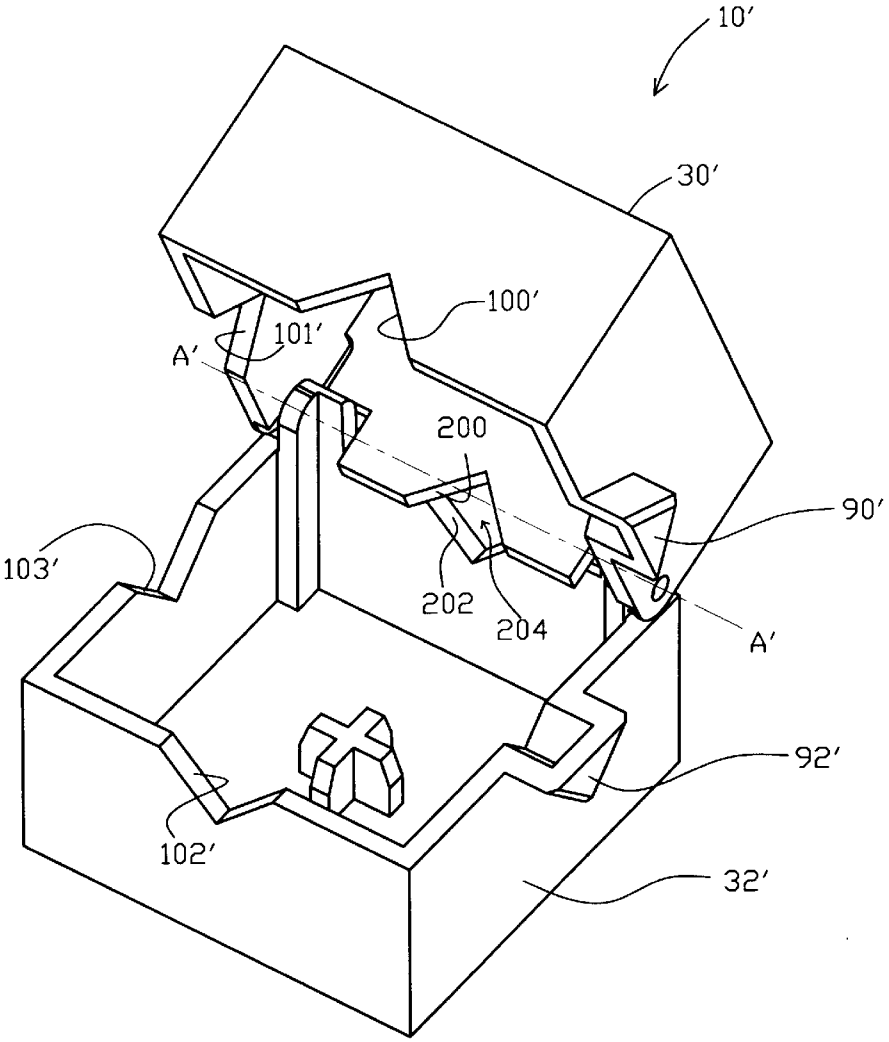

FIGS. 14 and 15 illustrate an alternate embodiment of a puzzle cube 10'. The alternate embodiment is substantially similar to the embodiment shown in FIG. 1 and may be used in combination or in association with the cube shown in FIG. 1. The cube 10' includes a top cube half 30' and a bottom cube half 32'. Like the FIG. 1 embodiment, the top cube half 30' and the bottom cube half 32' pivot relative to each other about a pivot axis A'—A'. A spring (not shown) urges the cube halves 30', 32' away from each other about the pivot axis. The alternate embodiment differs from the FIG. 1 embodiment in the positioning of the triangular-shaped cut-outs and the triangular-shaped protrusions. In particular, triangular-shaped protruding members 90', 92' define a diamond-shaped protrusion 94' on a side wall of the unit. Triangular-shaped cut-outs 100', 101', 102', 103' are formed on front and left side walls (as viewed in FIG. 14) of the puzzle unit. When the cube is placed in its closed position, the cut-outs define diamond-shaped openings similar to those defined by the FIG. 1 embodiment. In addition, triangular-shaped cut-outs 200, 202 are defined by the respective back walls of the upper and lower cube halves 30', 32'. As seen in FIG. 15, when the cube is placed in its closed position, an additional diamond-shaped opening 204 is defined in the back wall of the cube which is adapted to receive the diamond-shaped protrusion 94, 94' from an adjacent cube 10 or 10', respectively.

It should be understood that puzzle units constructed in accordance with the FIG. 1 embodiment may be used with puzzle units constructed according to the FIG. 14 embodiment and by using these units together, a greater number of variations of puzzles can be assembled.

Figure 16:
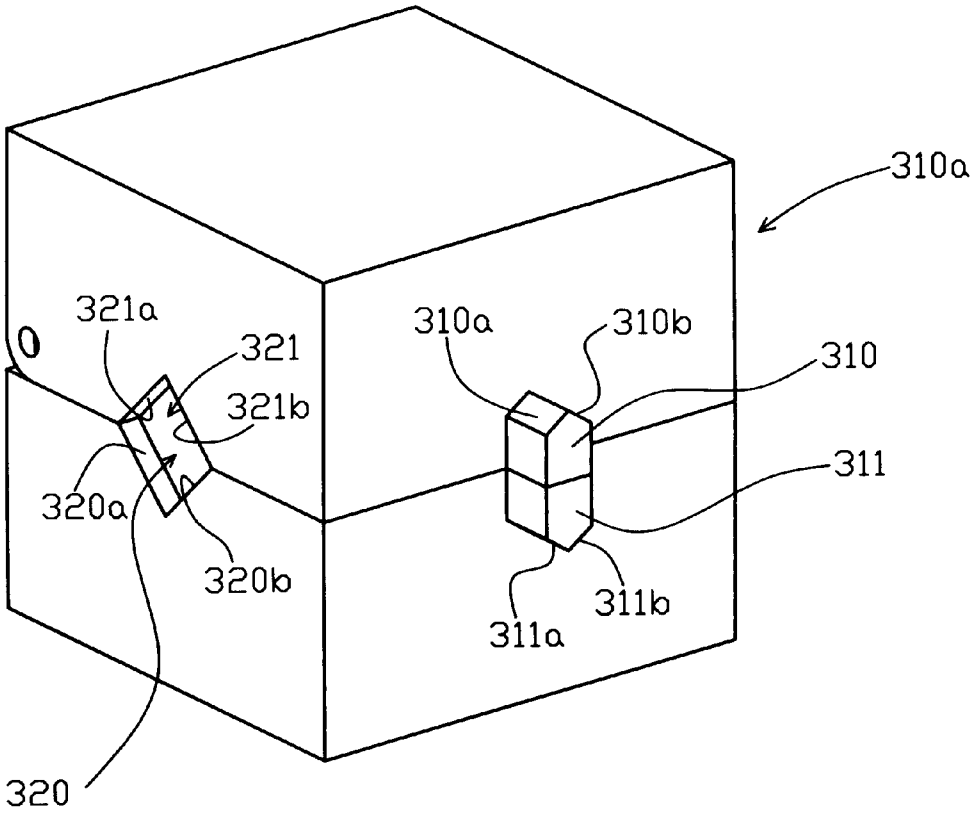
FIG. 16 is a perspective view of a puzzle unit constructed in accordance with an alternate embodiment of the invention.
Figure 23A:
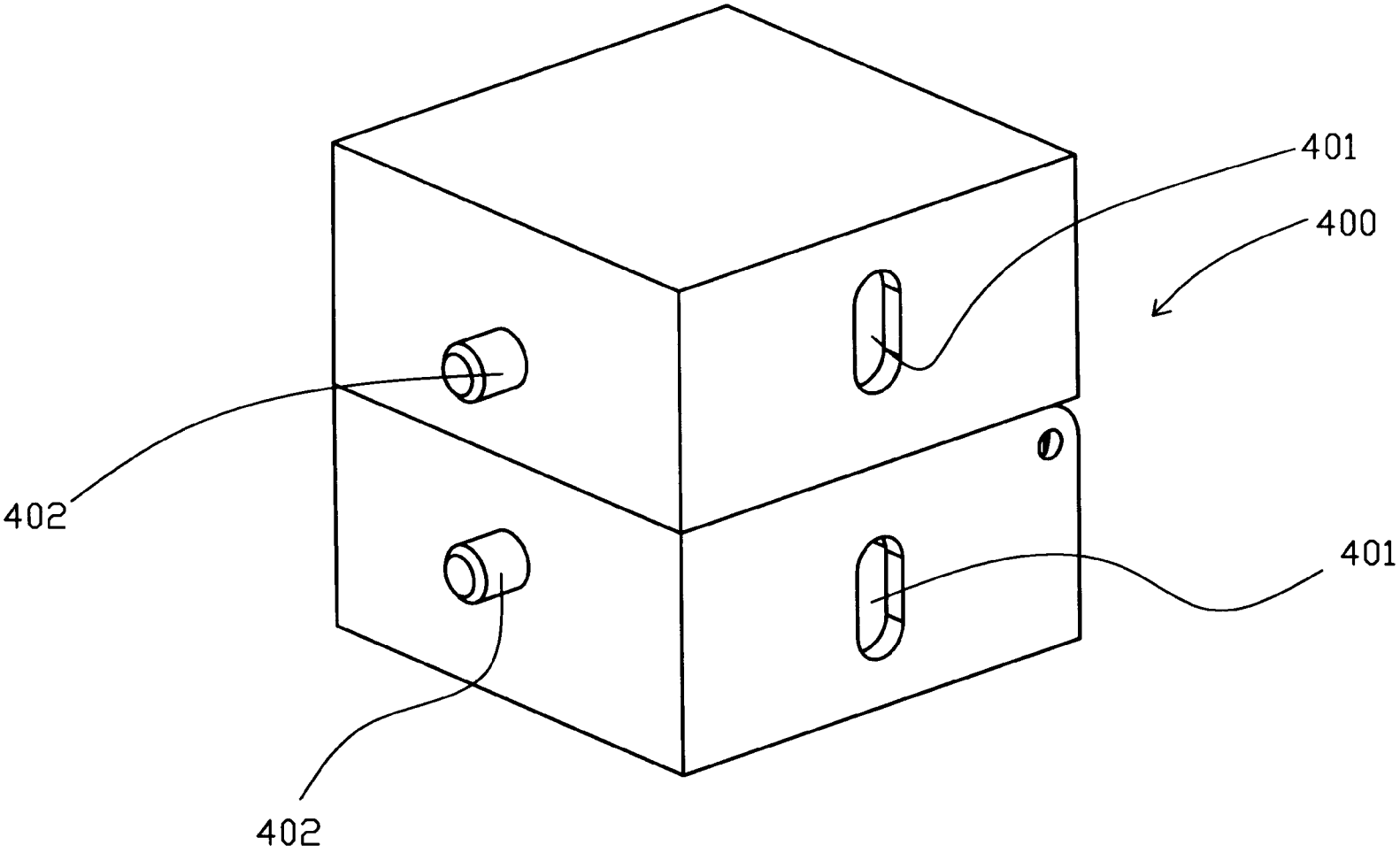
FIGS. 23A and 23B are perspective views of a puzzle unit constructed in accordance with an alternate embodiment of the invention.
Figure 23B:
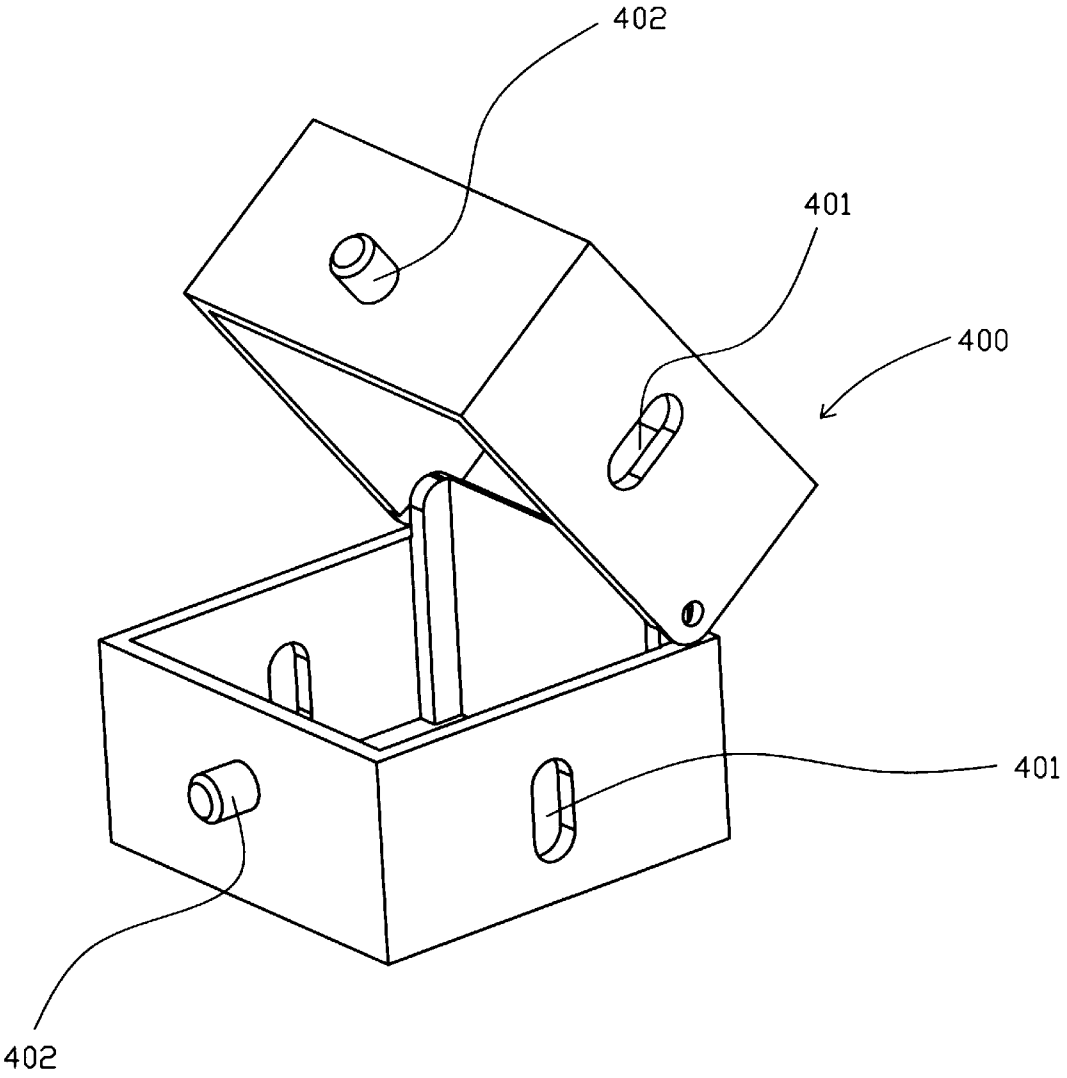

FIGS. 16–21 illustrate puzzle units constructed in various alternate embodiments of the present invention. FIG. 16 depicts a first puzzle unit 300 having a diamond shaped opening formed by cut-outs 320, 321. Protrusions 310, 311 have five sides, two of which 310*a*, 310*b* and 311*a*, 311*b* will engage the surfaces 321*a*, 321*b* and 320*a*, 320*b* respectively of a second substantially similar puzzle unit (not shown) when the first puzzle unit 300 is positioned adjacent the second puzzle unit. FIGS. 23A and 23B show a puzzle unit 400 having non-confronting openings 401 and protrusions 402.

Figure 17B:
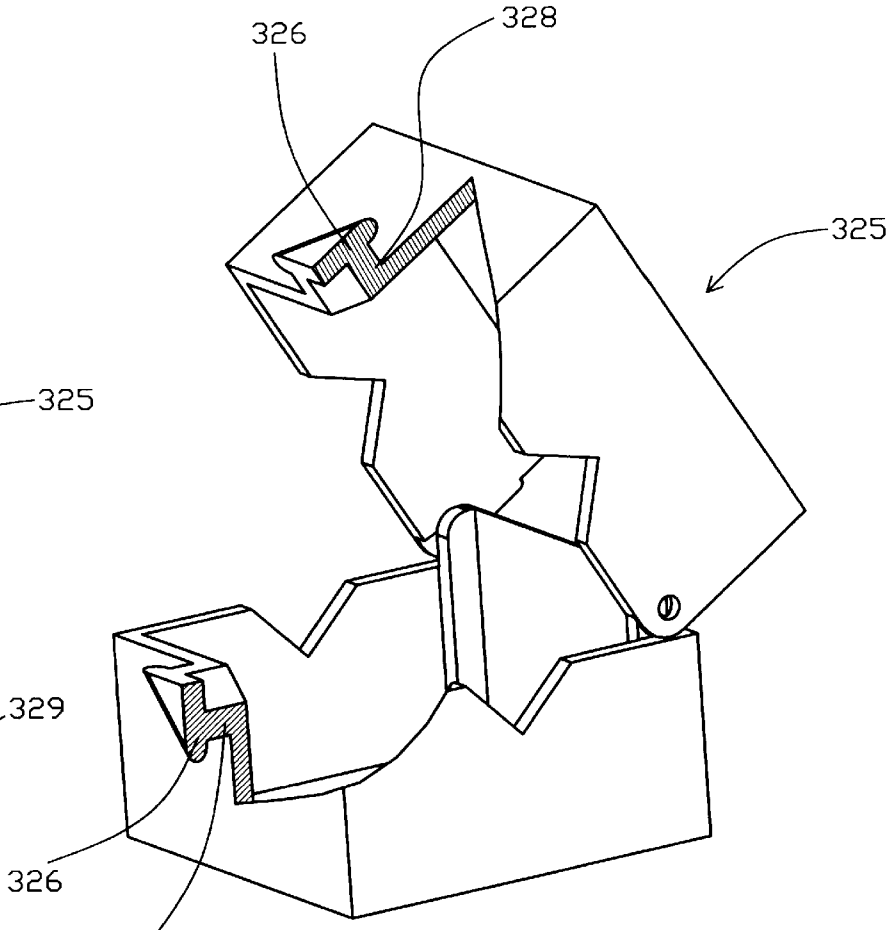
FIGS. 17A and 17B are perspective views of a puzzle unit constructed in accordance with an alternate embodiment of the invention.
Figure 17A:
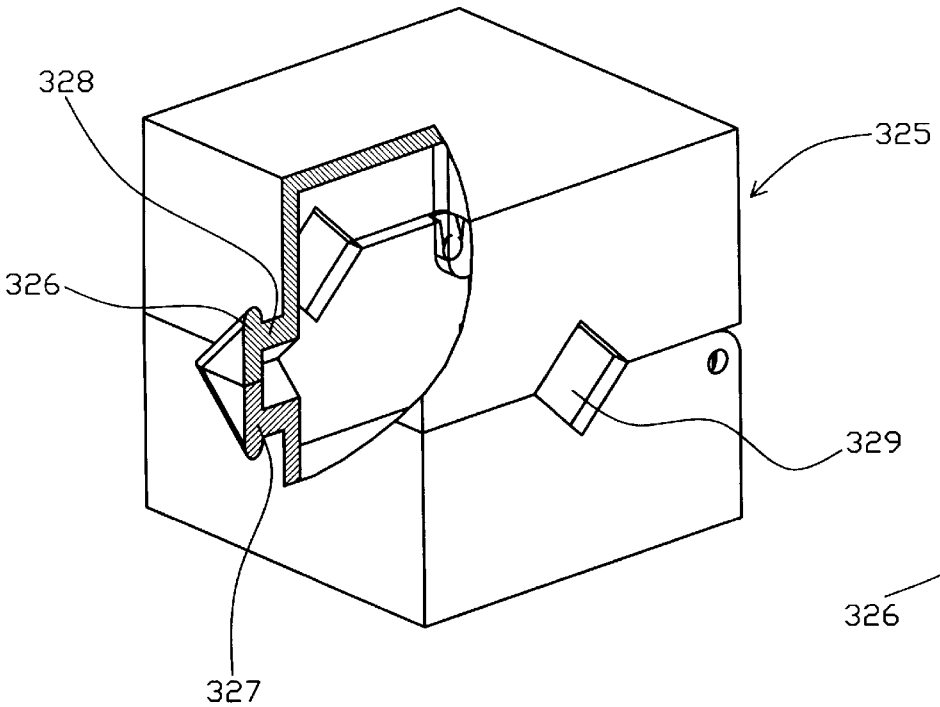
Figures 18A, 18B:
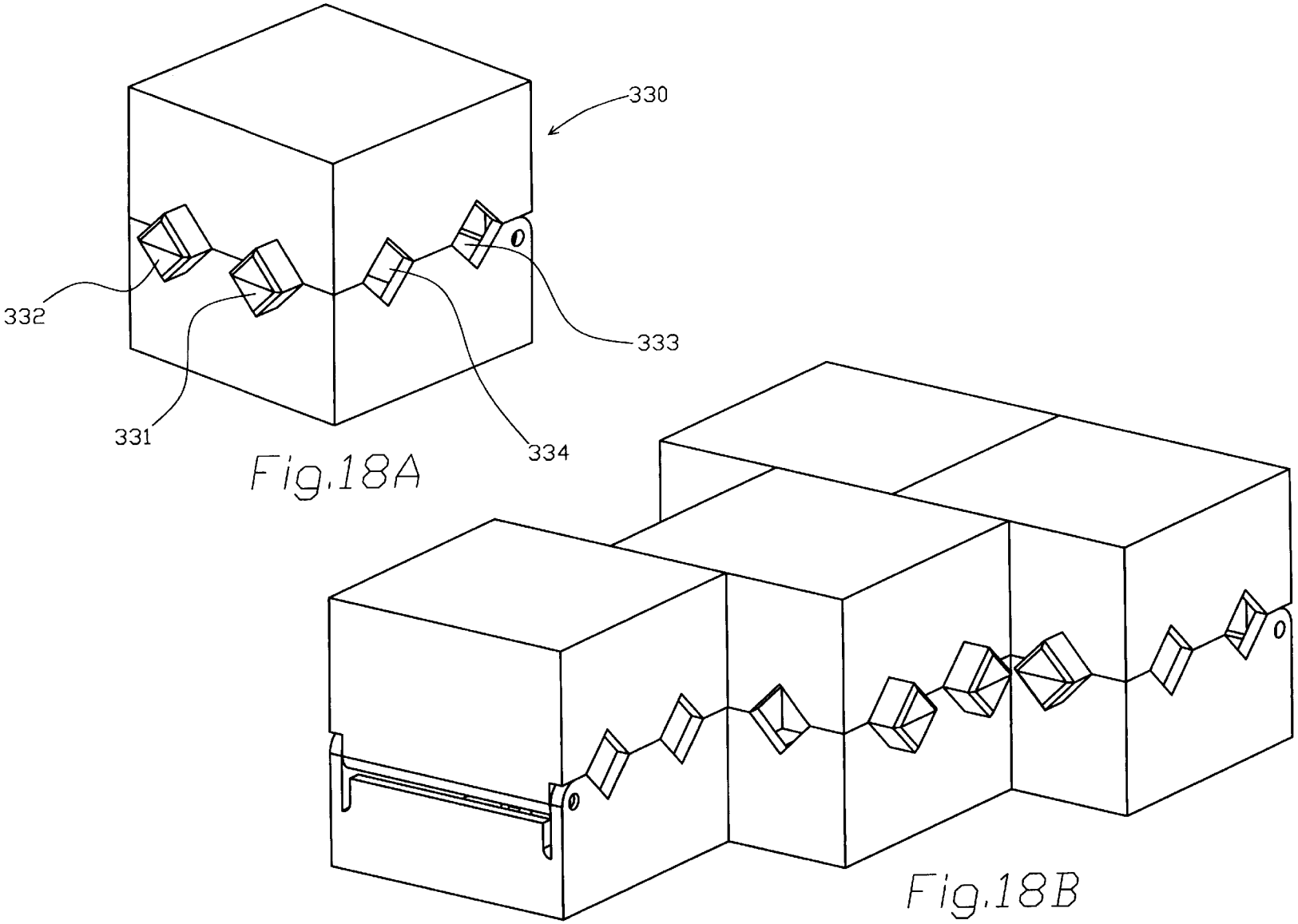
FIG. 18A and 18B are perspective views of a puzzle unit constructed in accordance with an alternate embodiment of the invention.

FIGS. 17A and 17B illustrate a puzzle unit 325 which has a flange 326 disposed around the protrusions 327, 328. The flange 326 is inserted into the opening 329 of an adjacent puzzle unit (not shown) prior to the adjacent unit being closed. When the adjacent unit is closed, the flange 326 is retained within the adjacent unit. FIG. 18A illustrates a puzzle unit 330 having a pair of protrusions 331, 332 on a wall configured to engage openings 333, 334 on an adjacent puzzle unit (not shown). FIG. 18B illustrates 4 puzzle units as shown in FIG. 18A interconnected in an offset manner.

Figure 19B:
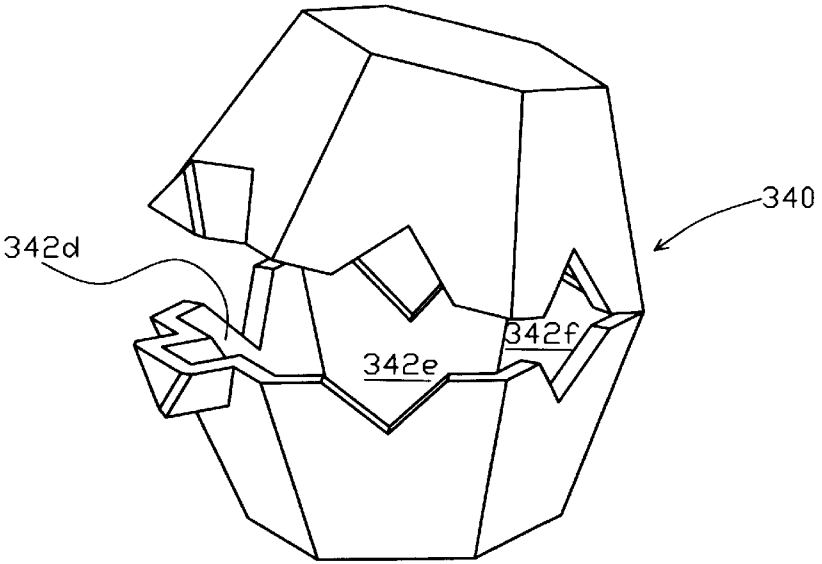
FIGS. 19A and 19B are perspective views of a puzzle unit constructed in accordance with an alternate embodiment of the invention.
Figure 19A:
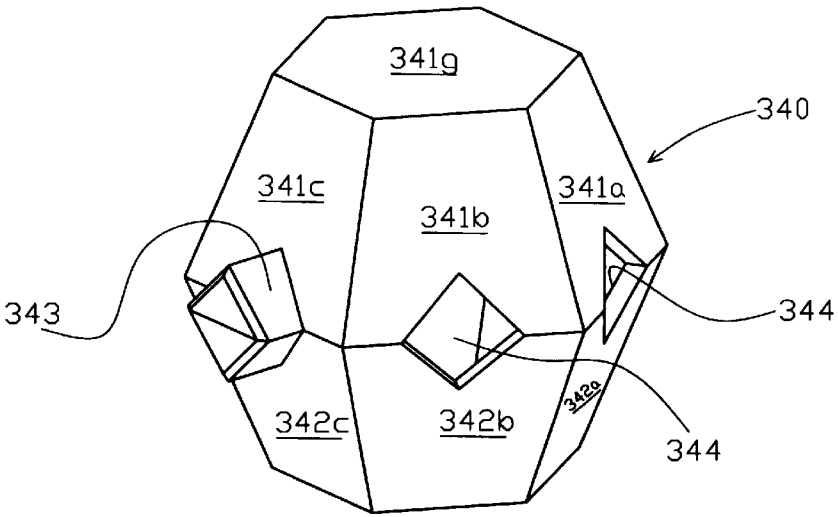
Figure 20:
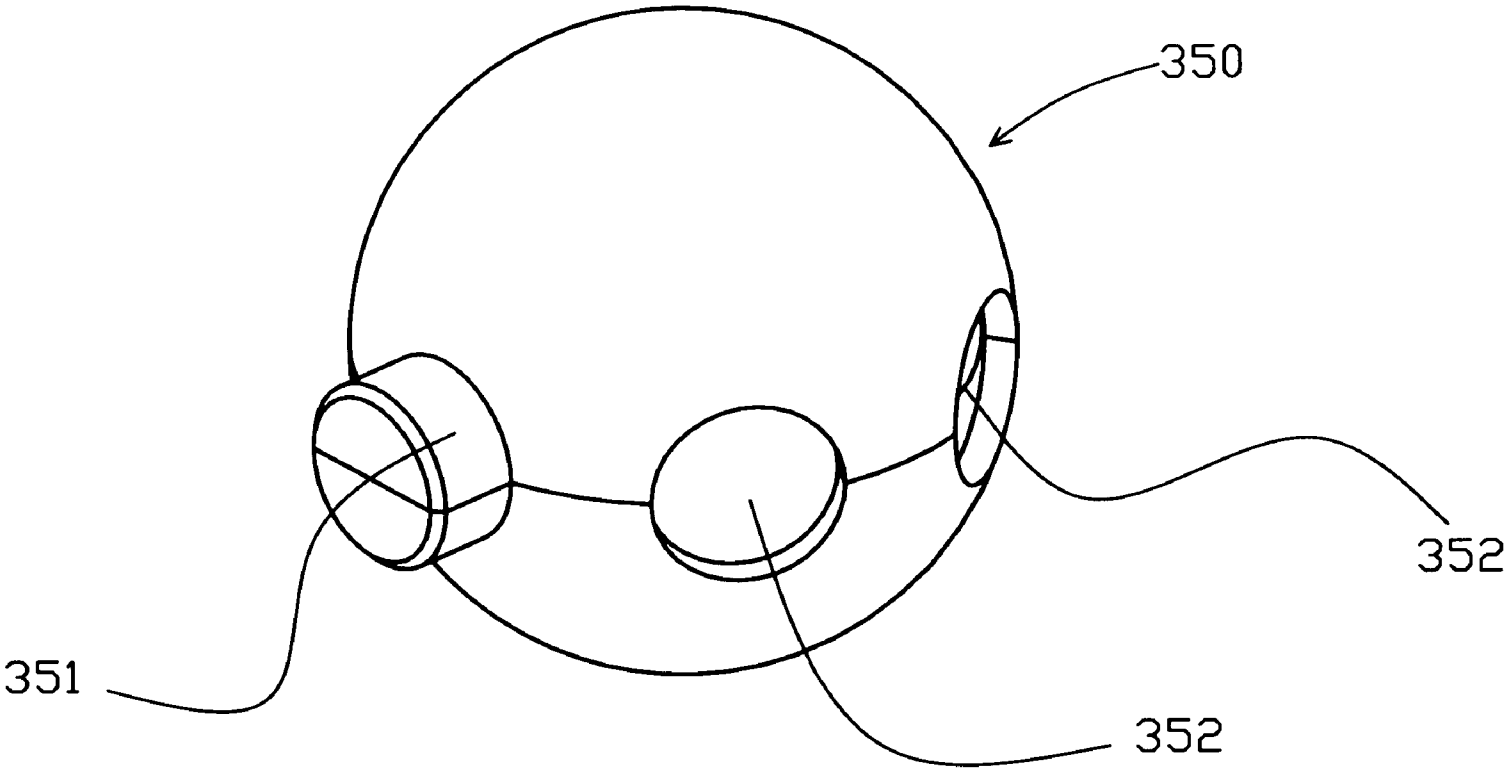
FIG. 20 is a perspective view of a puzzle unit constructed in accordance with an alternate embodiment of the invention.
Figure 21B:
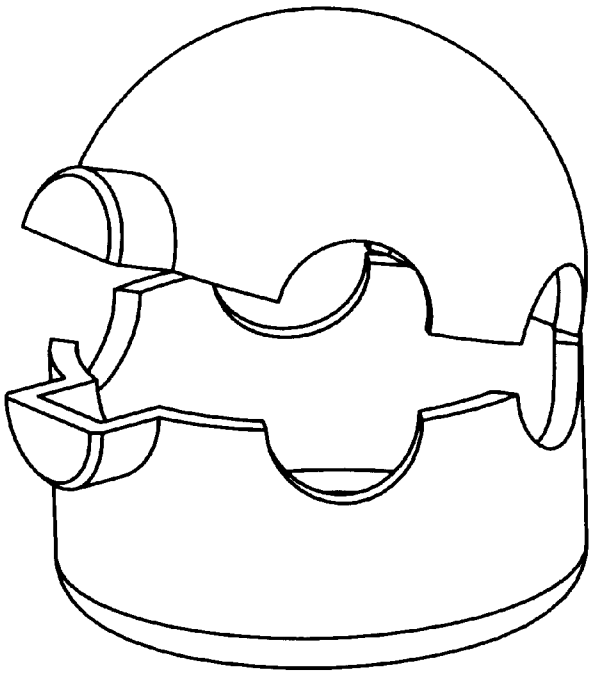
FIGS. 21A and 21B are perspective views of a puzzle unit constructed in accordance with an alternate embodiment of the invention.
Figure 21A:
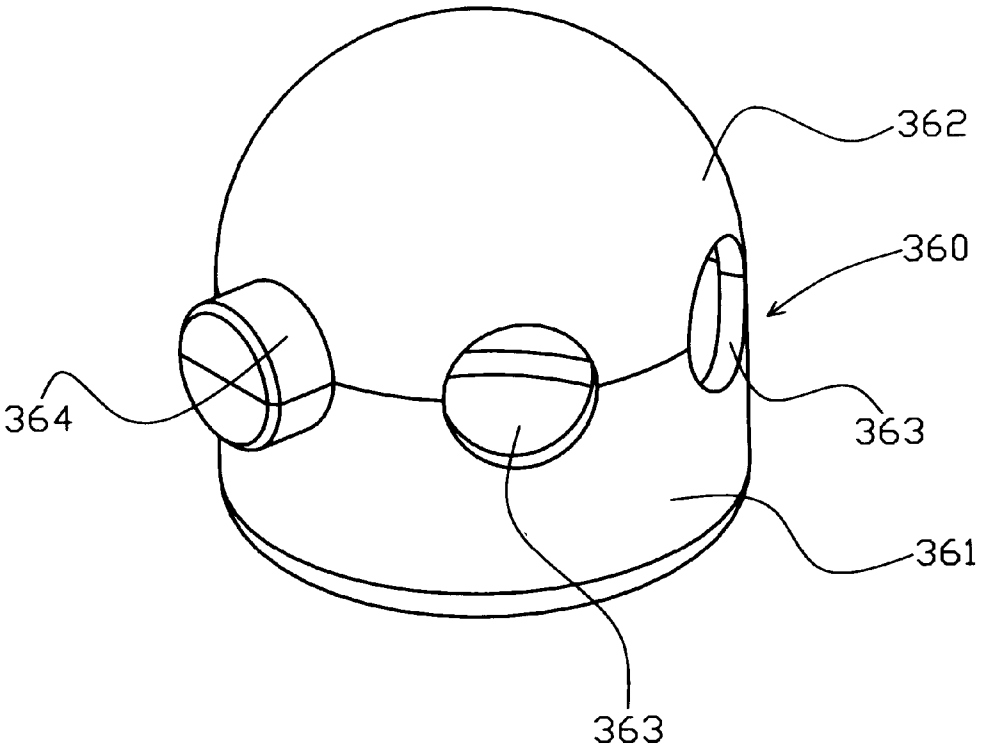
Figure 22:
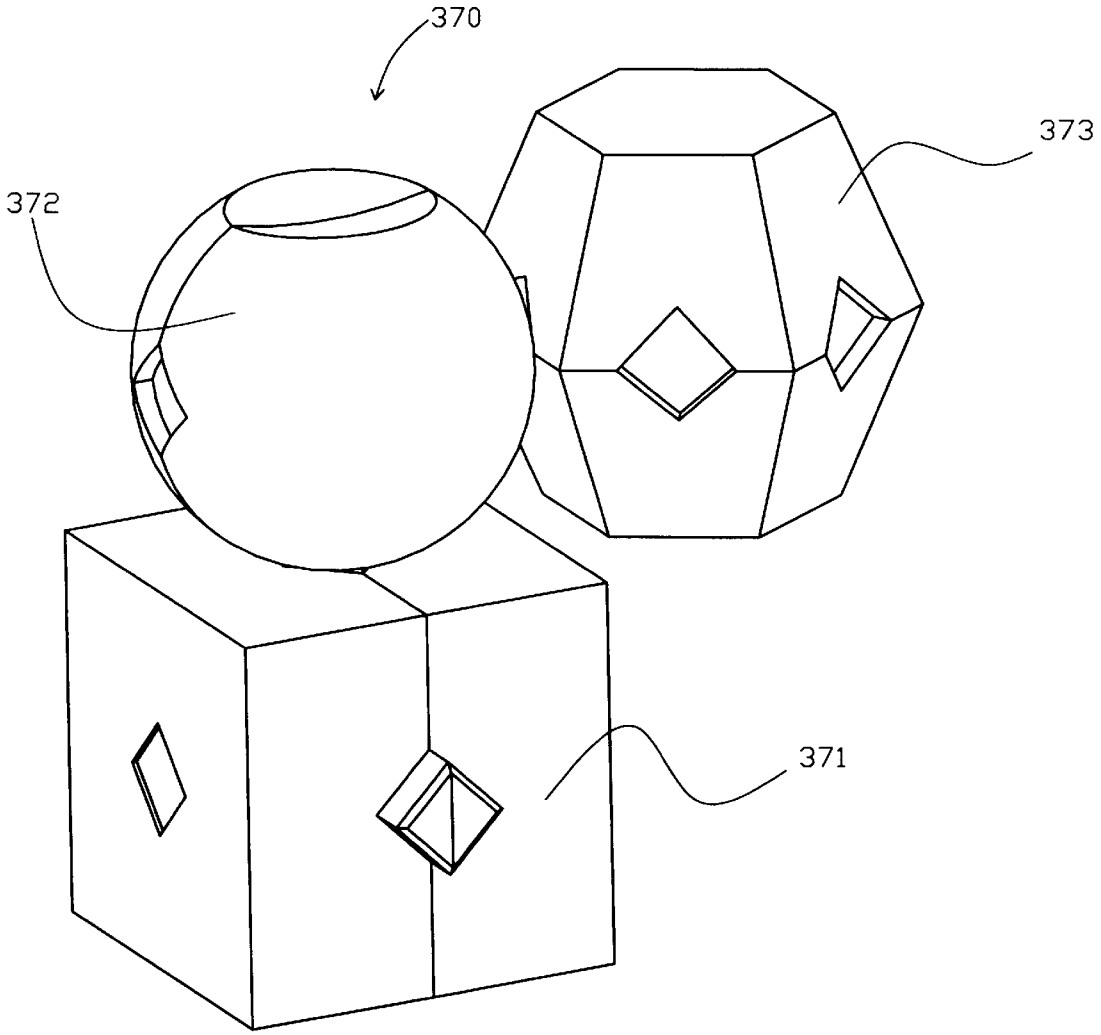
FIG. 22 is a perspective view of an interconnection of three puzzle units puzzle units constructed in accordance with alternate embodiments of the invention.

FIGS. 19–21 illustrate puzzle units having a non-cubical shape. FIGS. 19A and 19B illustrate a puzzle unit having two 7-sided halves 341,342, a protrusion 343 and openings 344. FIG. 20 illustrates a spherical puzzle unit 350 having circular shaped protrusions 351 and openings 352. Of course, protrusions of any shape may be featured in embodiments of the invention. FIGS. 21A and 21B illustrate a puzzle unit 360 having non-congruent halves 361, 362, a protrusion 364, and openings 363. FIG. 22 depicts a puzzle 370 comprised of puzzle units 371, 372, 373 having non-congruent shapes. In addition, the puzzle may form a desired shape, such as a car, when assembled correctly (not shown).

Although the invention has been described with a certain degree of particularity, it should be understood that those skilled in the art can make various changes to it without departing from the spirit or scope as hereinafter claimed.

I claim:

1. A puzzle comprising:

a) a first puzzle unit having a first portion pivotally connected to a second portion, said portions moveable to a closed position;

b) a biasing means urging said puzzle unit portions away from each other about said pivot towards an open position;

c) a first cut-out defined by said first portion and a second cut-out defined by said second portion, said cut-outs defining openings in said puzzle unit; and d) a first protruding member extending from said first portion and a second protruding member extending from said second portion, said protruding members sized and shaped to be received in an opening defined by an adjacent puzzle unit, such that maintaining closure of said adjacent puzzle unit maintains said first puzzle unit in its closed position.

2. The apparatus of claim 1, wherein said biasing means comprises a compression spring acting between said first and second portions.

3. The apparatus of claim 1, wherein said first and second cut-outs are arranged such that when said first and second unit portions are moved into abutting contact, said cut-outs confront each other and define an opening, and wherein said protruding members arranged such that when said first and second portions are moved into an abutting position, said members together define a protrusion that is sized and shaped to be received in an opening defined by an adjacent puzzle unit such that maintaining closure of said adjacent puzzle unit maintains said first puzzle unit in its closed position.

4. The apparatus of claim 1, wherein said cut-outs are triangular-shaped, said recess is diamond-shaped, and said protruding members are shaped complementally to said cut-outs such that a protrusion defined by said members when said portions are in the closed position is diamond-shaped and sized to be received within said diamond-shaped opening.

5. The apparatus of claim 1, wherein said first portion and said second portion are of identical shape.

6. The apparatus of claim 1, wherein said protrusion defined by said members fills substantially all of said opening formed by said cut-out when said protrusion is received in said opening of said adjacent puzzle unit.

7. The apparatus of claim 1, wherein said puzzle unit forms a substantially spherical shape when said portions are moved to a closed position.

8. The apparatus of claim 1, wherein said puzzle comprises a plurality of puzzle units arranged such that all puzzle units comprising the puzzle are maintained in a closed position by virtue of the engagements between said protrusions and said openings.

9. The apparatus of claim 8, wherein said puzzle units form a desired final shape when said puzzle units are arranged such that all puzzle units are maintained in a closed position by virtue of said engagements between said protrusions and said openings.

10. The apparatus of claim 1, wherein each of said puzzle units has a shape which is different from that of the other said puzzle unit.

11. The apparatus of claim 1, wherein said protruding member further comprises a flange disposed around a periphery of said member, said flange tending to maintain said receptive engagement of said member in said opening of said adjacent puzzle unit.

12. A puzzle comprising:

a) a first puzzle unit having a first portion pivotally connected to a second portion, said portions moveable to a closed position;

b) a biasing means urging said puzzle unit portions away from each other about said pivot towards an open position;

c) a first cut-out defined by said first unit portion of said unit and a second cut-out defined by said second unit portion, said first and second cut-outs arranged such that when said first and second unit portions are moved into abutting contact, said cut-outs confront each other and define an opening;

d) a first protruding member extending from a side wall of said first unit portion and a second protruding member extending from a corresponding side wall of said second unit portion, said members arranged such that when said first and second portions are moved into an abutting position, said members define a protrusion that is sized to be received in a recess defined by an adjacent puzzle unit, such that maintaining closure of said adjacent puzzle unit maintains said first puzzle unit in its closed position.

13. The apparatus of claim 12, wherein said biasing means comprises a compression spring acting between said first and second portions.

14. The apparatus of claim 12, wherein recesses are defined by opposed side walls of said puzzle unit when said first and second portions are moved into confronting engagement.

15. The apparatus of claim 12, wherein recesses are defined by front, side and rear side walls of said puzzle unit when said first and second portions are moved into abutting contact.

16. The apparatus of claim 12, wherein said cut-outs are triangular-shaped, said recess is diamond-shaped, and said protruding members are shaped complementally to said cut-outs such that a protrusion defined by said members when said portions are in the closed position is diamond-shaped and sized to be received within said diamond-shaped recess.

17. The apparatus of claim 12, wherein said puzzle unit is cube-shaped and is defined by six (6) equal sides when said first and second portions are moved into abutting contact.

18. The apparatus of claim 17, wherein said first and second portions, each are semi-cubed shaped.

19. The apparatus of claim 14, wherein a plurality of recesses are defined by each of said opposed side walls.

20. The apparatus of claim 15, wherein a plurality of recesses are defined by each of said front, side and rear side walls of said puzzle unit.

21. The apparatus of claim 12, wherein said puzzle comprises a plurality of puzzle units arranged such that all puzzle units comprising the puzzle are maintained in a closed position by virtue of the engagements between said protrusions and said recesses.

22. The apparatus of claim 15, wherein a plurality of protrusions are defined by each of said front, side and rear side walls of said puzzle unit.

23. A puzzle comprising:

a) a first puzzle unit having a semi-cubical first portion pivotally connected to a second semi-cubical portion, said portions moveable to a closed position wherein said puzzle unit has a cubical shape formed by six walls of equal size;

b) a biasing compression spring acting between said first and second portions urging said puzzle unit portions away from each other about said pivot towards an open position;

c) a first triangular shaped cut-out defined by said first unit portion of said unit and a second triangular shaped cut-out defined by said second unit portion, said first and second cut-outs arranged such that when said first and second unit portions are moved into abutting contact, said cut-outs confront each other and define a diamond shaped opening in opposed side walls of said puzzle unit;

d) a first protruding member extending from a side wall of said first unit portion and a second protruding member extending from a corresponding side wall of said second unit portion, said members arranged such that when said first and second portions are moved into an abutting position, said members define a protrusion that is sized to be received in a recess defined by an adjacent puzzle unit, such that maintaining closure of said adjacent puzzle unit maintains said first puzzle unit in its closed position.

* * * * *